US010519696B2

(12) United States Patent
Haber

(10) Patent No.: US 10,519,696 B2
(45) Date of Patent: Dec. 31, 2019

(54) PADLOCK ASSEMBLY WITH PROTECTIVE SHIELD

(71) Applicant: Greg Haber, Woodbury, NY (US)

(72) Inventor: Greg Haber, Woodbury, NY (US)

( * ) Notice: Subject to any disclaimer, the term of this patent is extended or adjusted under 35 U.S.C. 154(b) by 64 days.

(21) Appl. No.: 15/974,848

(22) Filed: May 9, 2018

(65) Prior Publication Data

US 2019/0153753 A1 May 23, 2019

Related U.S. Application Data

(60) Provisional application No. 62/589,812, filed on Nov. 22, 2017.

(51) Int. Cl.
*E05B 67/38* (2006.01)
*E05B 67/22* (2006.01)

(52) U.S. Cl.
CPC ..... *E05B 67/38* (2013.01)

(58) Field of Classification Search
CPC ..... E05B 67/38; E05B 67/22; E05B 67/383; E05B 2067/386
USPC ..... 70/54–56, 202, 203, 211, 212, 417, 70/DIG. 43; 292/205, DIG. 32
See application file for complete search history.

(56) References Cited

U.S. PATENT DOCUMENTS 2,541,638 A * 2/1951 Clevett ..... E05B 67/38 70/56
3,828,591 A * 8/1974 Beaver ..... E05B 67/38 70/56
3,838,586 A * 10/1974 Tennison ..... E05B 67/38 70/56
3,916,654 A * 11/1975 Mudge, Jr. ..... E05B 67/38 70/56
3,990,182 A * 11/1976 Linder ..... E01F 13/028 49/34
4,106,315 A * 8/1978 Dohanyos ..... E05B 67/38 292/281
4,372,138 A * 2/1983 De Forrest ..... E05B 67/38 70/168
4,535,612 A * 8/1985 Seremet ..... E05B 67/38 70/56
4,555,920 A * 12/1985 Stanich ..... E05B 67/38 70/54
4,744,229 A * 5/1988 Stanich ..... E05B 67/02 70/54

(Continued)

FOREIGN PATENT DOCUMENTS

GB 2185519 * 7/1987

*Primary Examiner* — Lloyd A Gall
(74) *Attorney, Agent, or Firm* — Epstein Drangel LLP; Robert L. Epstein

(57) ABSTRACT

The assembly includes a padlock having a lock body and a "U" shaped shackle. A protective shield is attached to one section of the shackle and is rotatable between a covered and uncovered positions relative to the padlock. In the unlocked position of the lock body, the shield may be moved to its uncovered position in which the lock body and the shackle are exposed. In its covered position, the shield protects the portion of the lock body and the shackle. In that position, the lock body can be moved to its locked position in which it cooperates with the shield to prevent the shield from being moved to its uncovered position. The assembly is mounted to a cargo access door over the latch handle such that the shield protects the padlock and the latch handle.

7 Claims, 8 Drawing Sheets

(56) References Cited

U.S. PATENT DOCUMENTS 4,760,720 A * 8/1988 Grille ..... E05B 67/38 70/417
4,819,465 A * 4/1989 Stanich ..... E05B 67/02 70/54
4,866,960 A * 9/1989 Brower ..... E05B 67/38 70/56
4,869,082 A * 9/1989 Appelbaum ..... E05B 19/0005 70/63
4,873,851 A * 10/1989 Arnett ..... B62D 43/007 70/259
4,882,918 A * 11/1989 Stanich ..... E05B 67/02 70/54
4,895,007 A * 1/1990 Eberly ..... E05B 67/38 292/104
4,915,257 A * 4/1990 Bailey ..... A47K 10/42 221/34
4,977,763 A * 12/1990 Sewell ..... E05B 67/38 70/417
5,156,029 A * 10/1992 Heald ..... E05B 67/02 215/321
5,219,384 A * 6/1993 Elsfelder ..... E05B 67/38 70/18
5,477,710 A * 12/1995 Stefanutti ..... E05B 67/38 70/417
5,765,408 A * 6/1998 Sanseverino ..... B60R 25/02147 70/14
6,058,745 A * 5/2000 Sanchez ..... E05B 67/38 70/417
6,257,032 B1 * 7/2001 Cecil ..... B62D 43/007 70/259
6,868,702 B1 * 3/2005 Alkire ..... E05C 19/003 70/14
7,003,989 B2 * 2/2006 St. James ..... E05B 67/38 70/54
7,201,027 B2 * 4/2007 Gogel ..... E05B 67/38 70/203
7,201,028 B1 * 4/2007 Gogel ..... E05B 67/38 292/205
7,257,970 B2 * 8/2007 St. James ..... E05B 67/38 70/54
7,412,856 B1 * 8/2008 Gogel ..... E05B 13/002 292/218
7,878,032 B1 * 2/2011 Gogel ..... E05B 67/38 292/205
2004/0107744 A1 * 6/2004 Chen ..... E05B 65/48 70/2
2006/0201210 A1 * 9/2006 Gogel ..... E05B 67/38 70/56
2006/0201211 A1 * 9/2006 Gogel ..... E05B 67/38 70/56

* cited by examiner

PADLOCK ASSEMBLY WITH PROTECTIVE SHIELD

CROSS-REFERENCE TO RELATED APPLICATIONS

Priority is claimed on Provisional Patent No. 62/589,812, filed Nov. 22, 2017, which is incorporated herein in its entirety.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to security devices for protecting cargo in a cargo compartment from theft and more particularly to a padlock assembly with protective shield for securing the latch handle of a moveable cargo compartment access door of the type used on trucks, vans, railroad cars and other vehicles.

2. Description of Prior Art Including Information Disclosed Under 37 CFR 1.97 and 1.98

Many types of cargo compartment access doors utilize padlocks to prevent unauthorized access to cargo. However, padlocks protecting cargo compartment access doors on vehicles are particularly vulnerable to attack while the vehicles are in transit. Sliding doors on railway cars and side mounted swing-out doors on trucks are commonly equipped with handles which can be rotated between latched and unlatch positions. Such latch handles are commonly provided with an opening. When the latch handle is in its latched position, the opening in the handle aligns with an opening on a fixed part of the vehicle such the shackle of a padlock can be received through the aligned openings to prevent the handle from being moved away from its latched position and thus protect against unauthorized access to the cargo compartment. When used in that manner, the padlock is completely exposed to damage from external assault by thieves using a variety of different tools to cut the shackle or break the lock body.

For example, sliding cargo compartment access doors are commonly provided with latch having a handle that is rotated between a latched position, wherein the door frame is engaged preventing the door from opening, and an unlatched position, wherein the door frame is not engaged such that the door may be opened. The door has a bracket which is fixed to the exterior surface of the door. The bracket typically has parallel parts protruding from either end. In the latched position, the handle is situated in the bracket between the protruding parts.

The protruding bracket parts have aligned openings such that a plastic or metal seal can be secured over the handle. The seal is not designed to prevent movement of the handle or opening of the door. Instead, the purpose of the seal is to act as a visual indicator of whether the latch handle has been moved toward its unlocked position because the seal must be broken in order to rotate the handle from its latched position in the bracket to open the door. Thus, as long as the seal is unbroken, it is a reliable indicator that the cargo compartment has not been entered without authorization.

To provide additional security, a conventional padlock with an elongated shackle may be used with or instead of a seal. Once the latch handle is in its latched position between the bracket parts, the shackle of the padlock is inserted through the aligned openings in the bracket parts, above the latch handle, and locked. The padlock prevents the handle from being moved from its latched position in the bracket. The door cannot be opened without removing the padlock.

However, when a conventional padlock is mounted on the door in this manner, the lock body and the shackle are exposed and can be cut, hammered or otherwise compromised, allowing the padlock to be removed. Removing the padlock allows the door to be opened such that the contents of cargo compartment can be accessed.

The present invention is intended to prevent the lock body and/or shackle of a padlock from being attacked by providing a strong metal shield to protect the padlock, and anything else which may be situated under the shield such as a seal, from being exposed to attack.

BRIEF SUMMARY OF THE INVENTION

It is, therefore, a prime object of the present invention to provide a padlock assembly with a protective shield.

It is another object of the present invention to provide a padlock assembly with a protective shield which is adapted for use with a door with a moveable latch handle.

It is another object of the present invention to provide a padlock assembly with a protective shield which is adapted for use with a door having a latch handle designed to cooperate with a fixed engaging part.

It is another object of the present invention to provide a padlock assembly with a protective shield which includes a cover which is retained in a position covering the padlock when the lock body in the locked position.

It is another object of the present invention to provide a padlock assembly with a protective shield in which the lock body is retained by the shield, when the lock body is in the locked position.

In accordance with one aspect of the present invention, a padlock assembly is provided including padlock having a lock body and a generally "U" shaped shackle. The lock body is moveable relative to the shackle between locked and unlocked positions. The shackle includes an elongated section having an end attached to the lock body. The assembly further includes a protective shield moveable between a covered position and an uncovered position relative to the padlock.

The shield includes a wall defining an interior space. A tubular member is permanently affixed to the shield wall within the interior space. The elongated section of the shackle extends through the tubular member. That allows the shackle to rotate to a position in which the other elongated section of the shackle can be received in the openings of the bracket such that the padlock assembly is mounted to the cargo door.

As long as the lock body is not in its locked position, the shield may be moved to its covered position wherein the shackle and at least a portion of the lock body are situated in the interior space of the shield and are no longer exposed. The shield is retained in its closed position by moving the lock body into alignment with and towards the shackle to its locked position within the shield.

In accordance with another aspect of the present invention, a padlock assembly is provided for use on a door with a fixed bracket having spaced protruding parts with aligned openings. The door has a latch handle moveable between a first position wherein the door may be opened and a second position, between the protruding parts of the bracket, wherein the door cannot be opened.

The padlock assembly includes a padlock having a lock body and a generally "U" shaped shackle. The lock body is moveable relative to the shackle between locked and unlocked positions. The shackle includes a first elongated section having an end attached to the lock body and a second elongated section.

The padlock assembly further includes a protective shield moveable between a covered position and an uncovered position. The shield includes a wall defining an interior space. A tubular member is permanently affixed to the shield wall. The first elongated section of the shackle extends through the tubular member to connect the shackle and the shield. In the unlocked position of the lock body, the shield may be moved to its uncovered position in which the lock body and the shackle are exposed.

In that position, the second elongated section of the shackle may be received through the aligned openings in the bracket parts when the latch handle is in its second position. The shield may then be moved to its covered position wherein the shackle and at least a portion of the lock body are situated in the interior space of the shield.

When the shield is in its covered position, the lock body may be moved to its locked position in which the lock body cooperates with the shield to prevent the shield from being moved from its covered position to expose the lock body and shackle.

The end of the first elongated section of the shackle is attached to the lock body for linear and rotational movement relative to the lock body.

The shield wall has a substantially semi-cylindrical shape. The shield has a closed end and an open end.

The section of the shield proximate the open end is configured to receive a portion of the lock body when the shield is in its covered position. The shield section includes an arcuate part extending beyond the edge of the shield wall. The arcuate part defines an interior space which is larger in diameter than the interior space defined by the shield wall itself.

A portion of the lock body is received within the arcuate part of the shield when the shield is in its covered position and the lock body is in its locked position. The arcuate part has an end part which extend toward the interior space of the arcuate part and which prevents the shield from being moved to its uncovered position.

BRIEF DESCRIPTION OF THE SEVERAL VIEWS OF DRAWINGS

To these and to such other objects that may hereinafter appear, the present invention relates to a padlock assembly as described in detail in the following specification and recited in the annexed claims, taken together with the accompanying drawings, in which like numerals refer to like parts and in which:

DETAILED DESCRIPTION OF THE INVENTION

Figure 1:
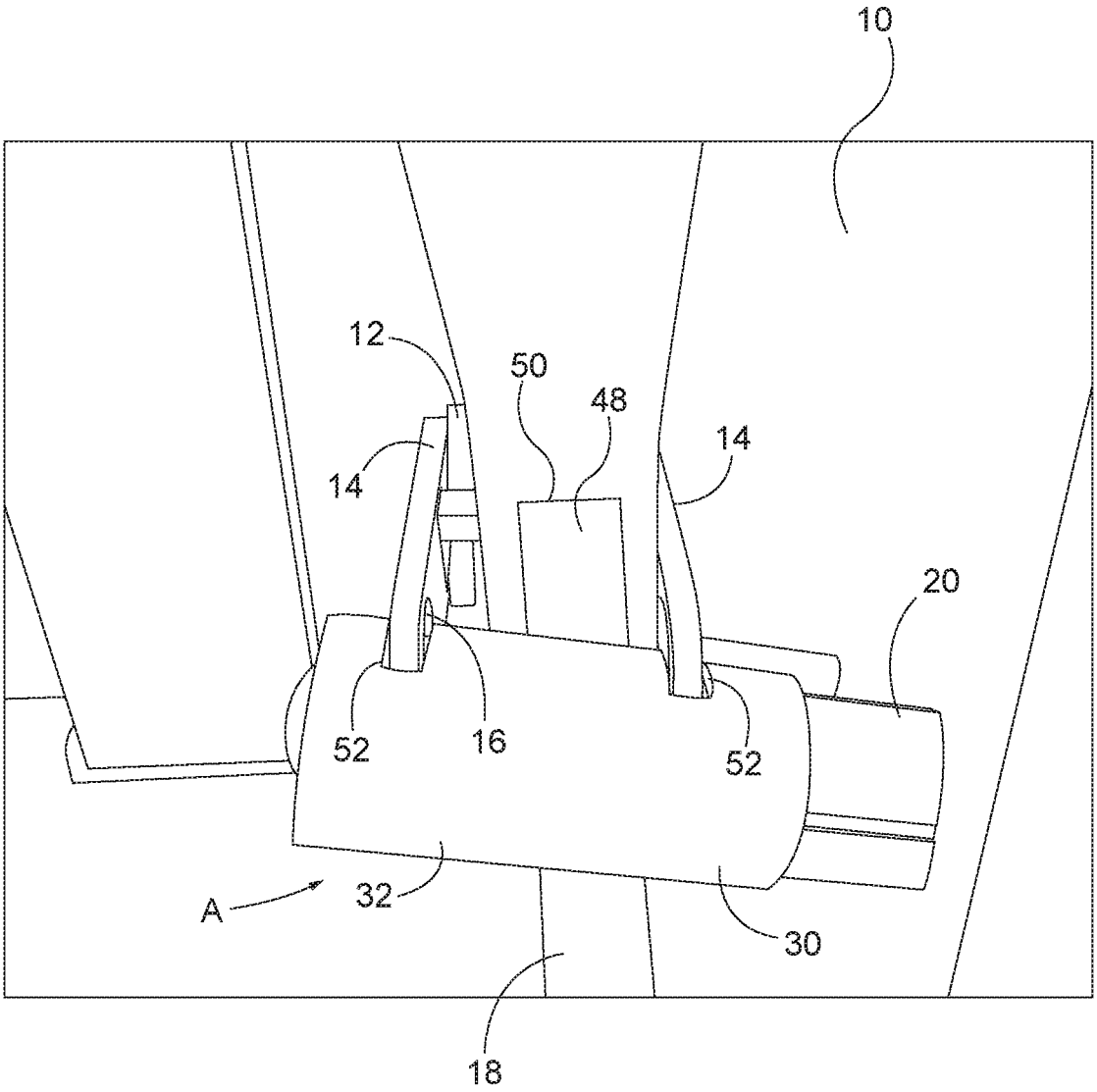
FIG. 1 shows the padlock assembly of the present invention mounted on a cargo compartment access door.
Figure 2:
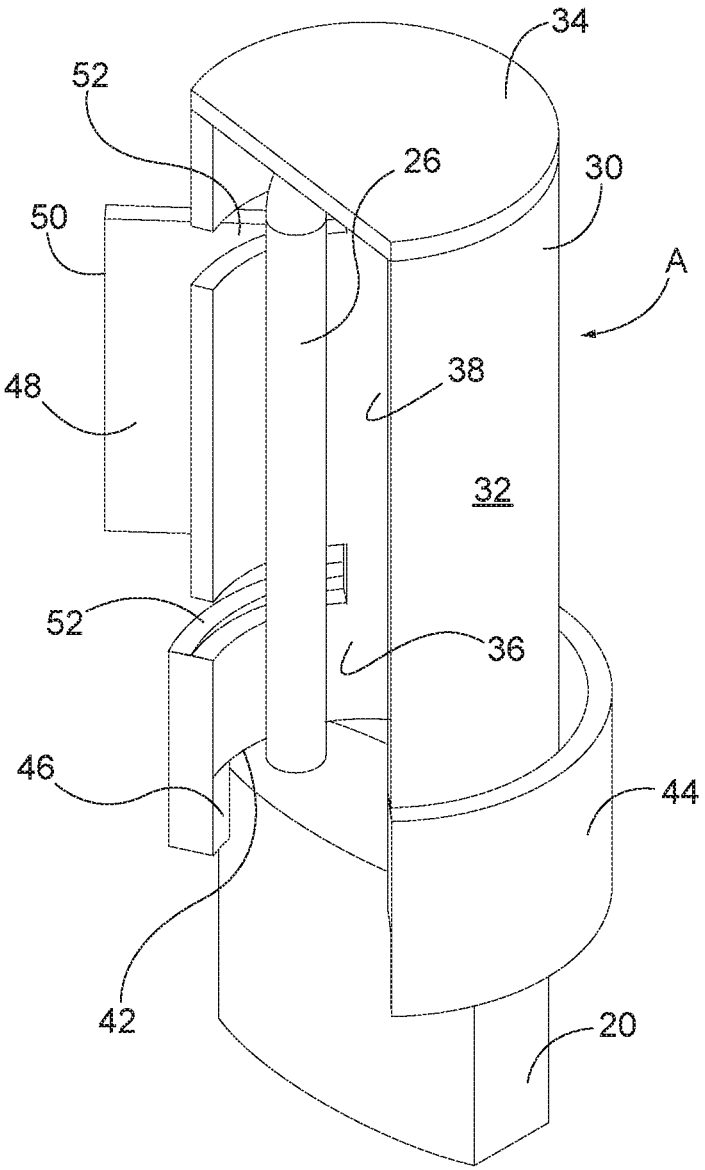
FIG. 2 is a perspective view of the padlock assembly of the present invention with the shield in its covering position and the lock body in its locked position.
Figure 3:
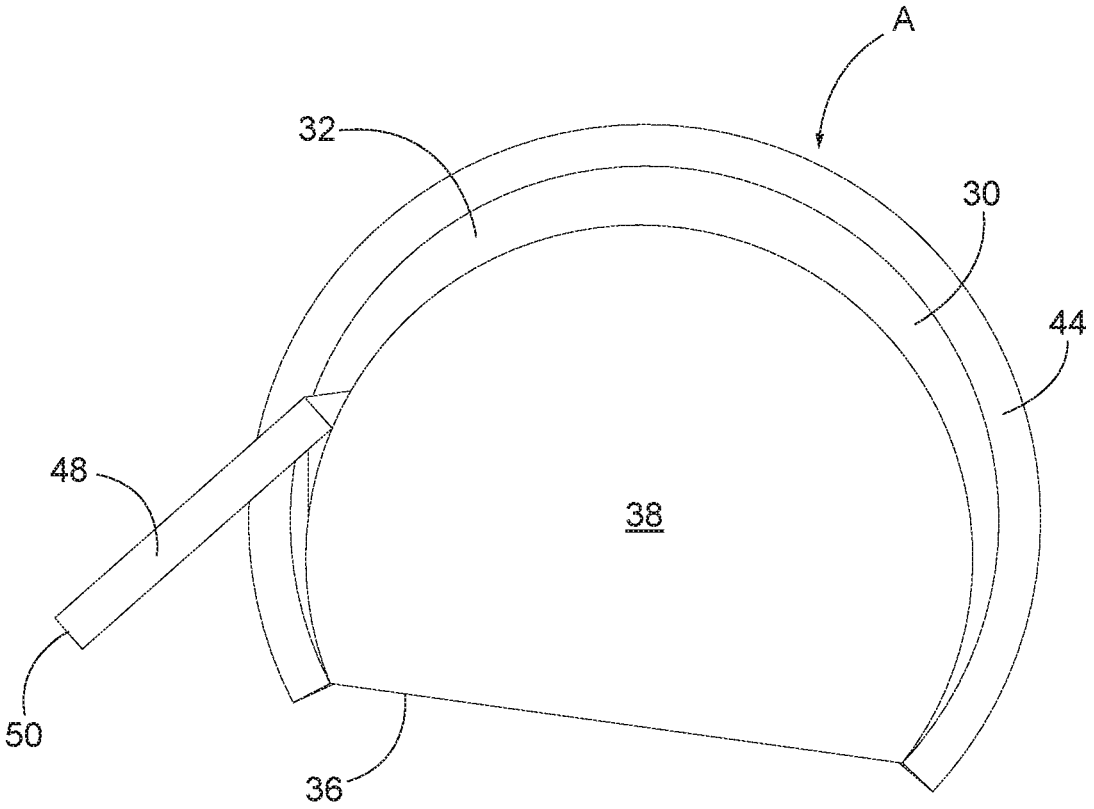
FIG. 3 is an elevation view of the shield without the padlock as seen from the closed end of the shield.

As illustrated in FIG. 1, the padlock assembly of the present invention, generally designated A, is intended for use on a cargo compartment assess door 10. A bracket 12 is fixed to the exterior surface of the door. Bracket 12 includes spaced protruding parts 14 with aligned openings 16 (only one of which is visible in FIG. 1) at either end.

Door 10 has a conventional lock with a latch handle 18. The handle is rotatable between a horizontal position (not shown) wherein the door may be opened and a vertical position, shown in FIG. 1, in which the handle is situated between the protruding parts 14 of bracket 12. In that handle position, the cargo door cannot be opened and the cargo compartment cannot be accessed.

Assembly A includes a conventional padlock having a lock body 20 and a generally "U" shaped shackle 22. The shackle includes a first elongated section 24 and a second elongated section 26 connected by an intermediate section 28. The end of section 24 of the shackle is permanently attached to the lock body such that the lock body is in its unlocked position, the lock body is linearly and rotatably moveable relative to shackle 22.

The lock body can be moved relative to the shackle between a locked position shown in the drawings, wherein the ends of both shackle sections 24, 26 are retained in the lock body, and an unlocked position (not shown in the drawings) wherein the lock body 20 is linearly moved a small distance such that it is remote from the end of section 26 of the shackle. In the unlocked position of the lock body, the lock body can be rotated relative to the shackle exposing section 26 such that section 26 of the shackle can be received in the openings in the bracket parts and thus in position on the cargo door.

The padlock assembly further includes a protective shield 30 formed of a wall 32. Wall 32 is fabricated of thick steel stock and is very strong. Wall 32 is closed at one end by an end piece 34. Wall 32 has the general shape of a cylinder section with a cut-away portion defining an opening 36. Opening 36 faces the cargo door when the assembly is mounted on bracket 12.

Shield 30 is moveable relative to the padlock between a covered position in which the portion of the lock body and the shackle are protected, shown in the drawings and an uncovered position, in which the shield is rotated away from the padlock leaving the lock body and shackle exposed.

Figure 5:
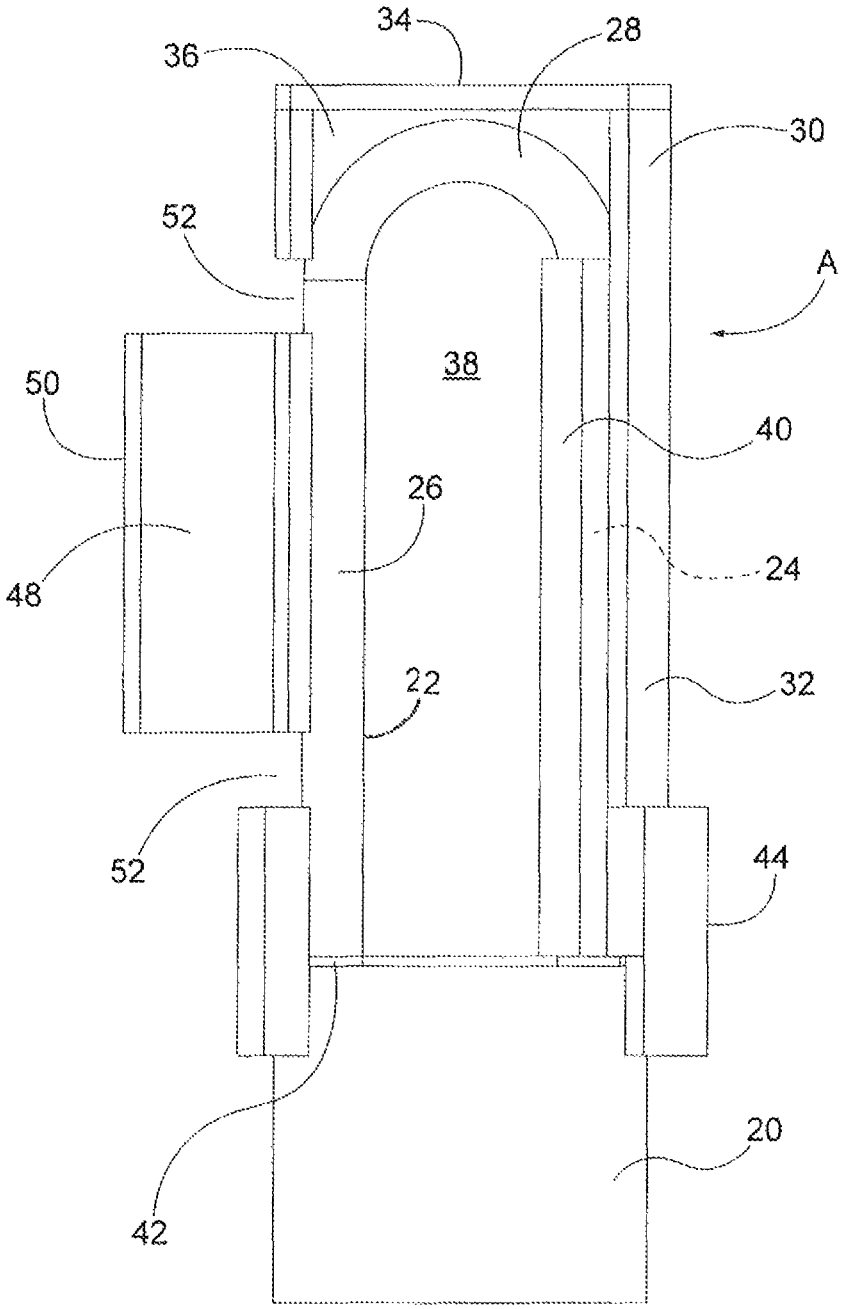
FIG. 5 is a bottom plan view of the padlock assembly.
Figure 6:
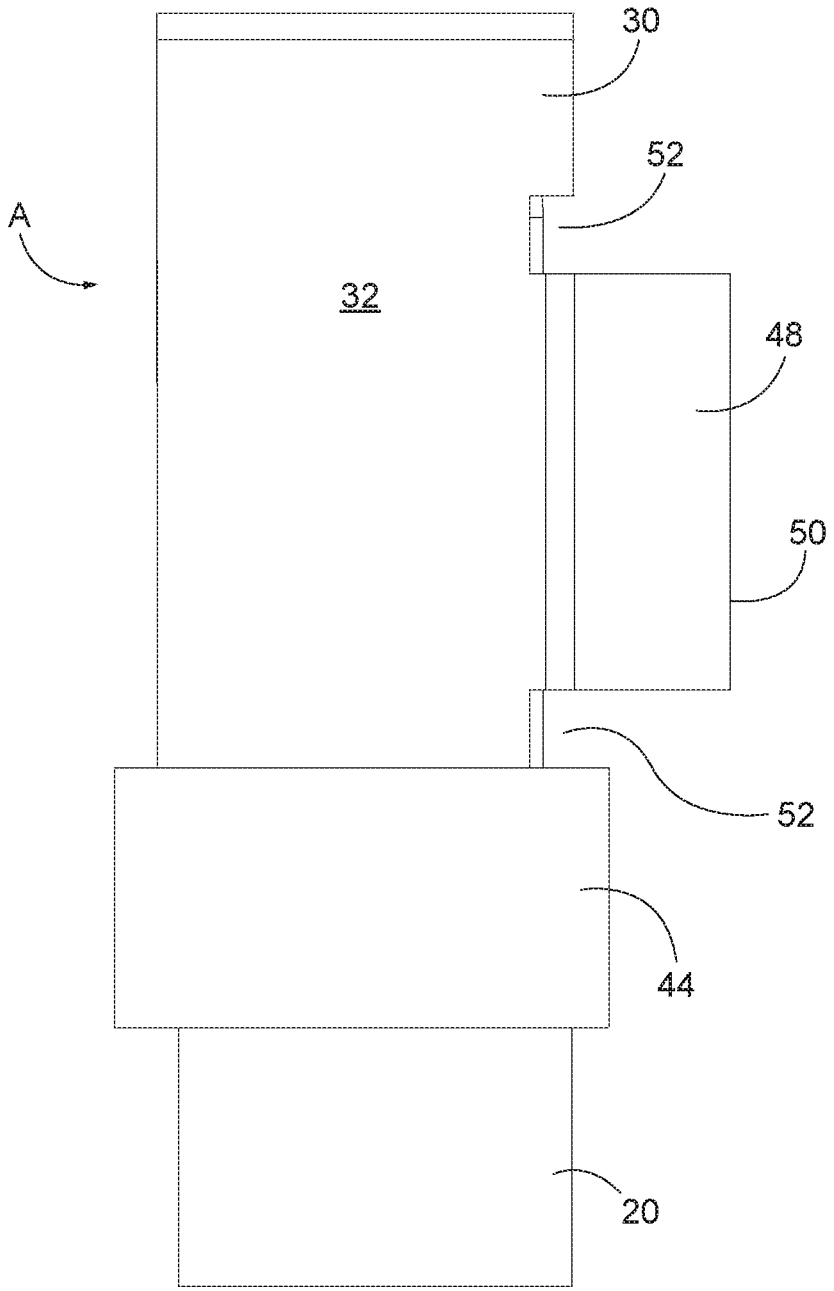
FIG. 6 is a top plan view of the padlock assembly.
Figure 7:
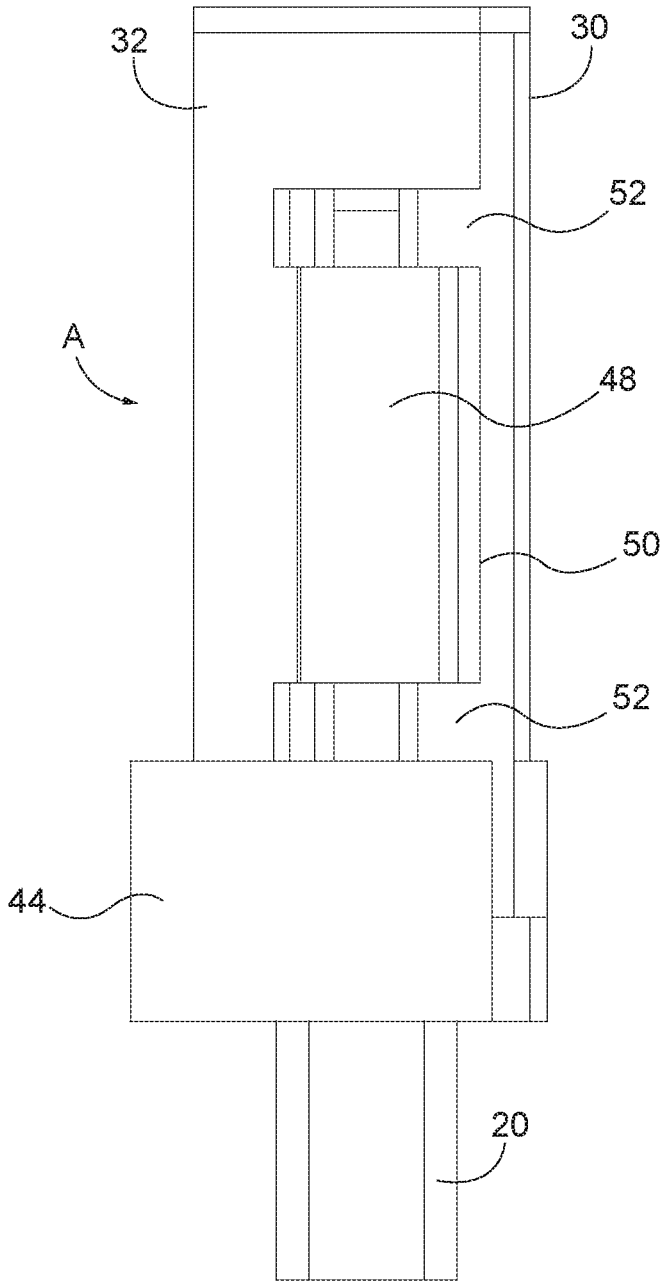
FIG. 7 is an elevation view of one side of the padlock assembly.
Figure 8:
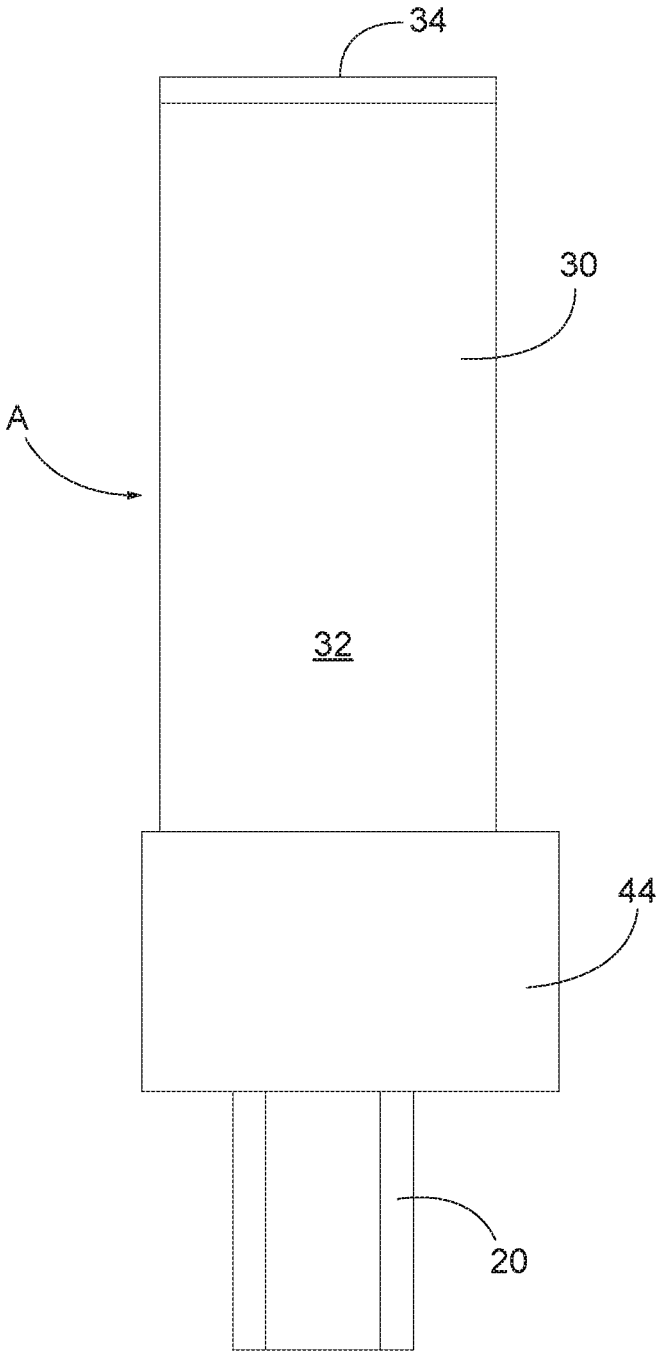
FIG. 8 is an elevation view of the other side of the padlock assembly.

Wall 32 defines an interior space 38. A tubular member 40 is permanently affixed to the interior surface of wall 32 within space 38, as best see in FIG. 5. Shackle section 24 extends through tubular member 40 such that the shield is permanently attached to the shackle. However, the shield may be rotated relative to the shackle as long as the lock body is in its unlocked position.

When the shield is in its open position, the lock assembly can be mounted on the door. Once the assembly is mounted on the door, the shield may be rotated to cover the shackle. In that rotated position, the lock body is aligned with the open end of the shield, defined by edge 42 but is spaced from the edge. The lock body can then be moved toward the shackle to its locked position wherein it abuts edge 42 of the shield wall.

An arcuate collar 44 is attached to and surrounds the open end of the shield. Collar 44 is made of the same thick steel stock as the shield wall. A portion of collar 44 overlaps and extends beyond edge 42 of the shield. The portion of collar 44 which extends beyond the shield wall defines a space which is somewhat larger in diameter than the diameter of the interior space 38 defined by the shield wall.

Figure 4:
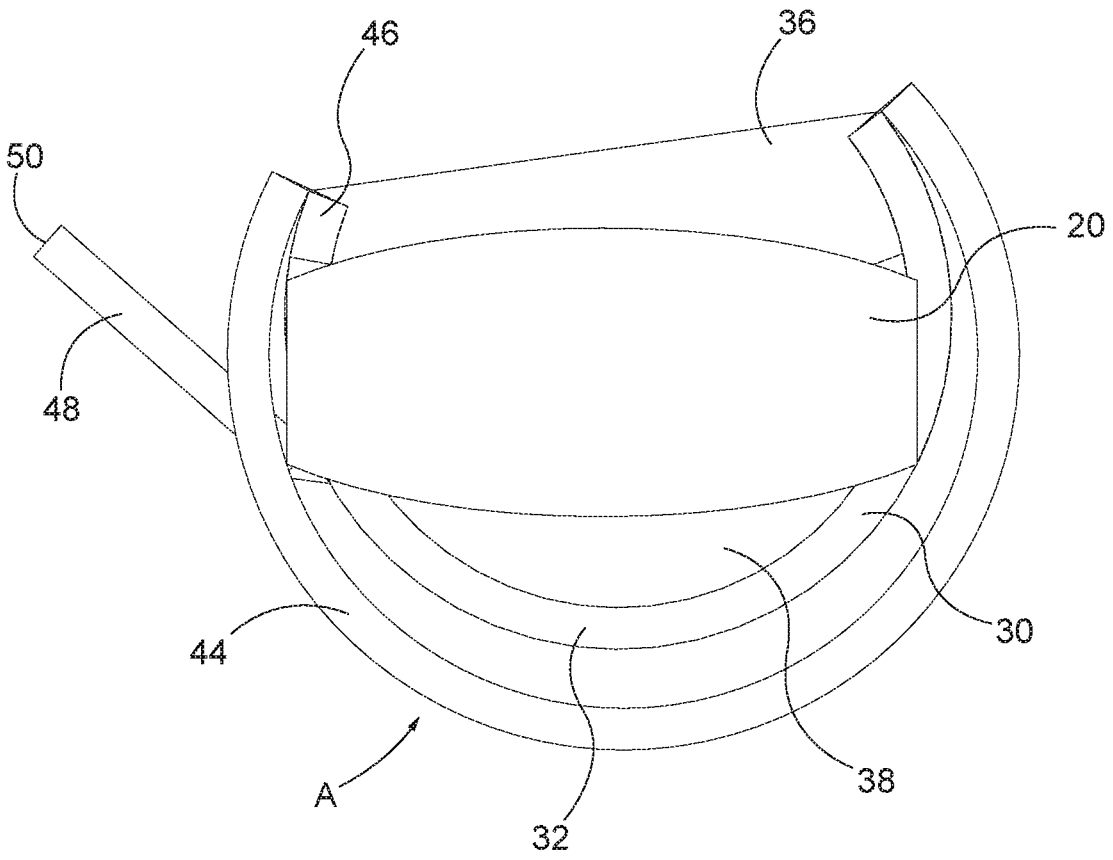
FIG. 4 is an elevation view of the shield with the padlock therein, as seen from the open end.

The lock body 20 is small enough to be received within the protruding portion of the collar when the lock body is in the locked position but is too big to enter the interior space 38 of the shield. As best seen in FIG. 4, one end of collar 44 has a radially inwardly extending part 46. Part 46 limits the rotation of the shield relative to the padlock such that in the locked position of the lock body, the shield cannot be rotated to its uncovered position to expose the lock body or the shackle within the shield.

Extending outwardly from the exterior surface of the shield, on the side opposite to the side where tubular member 40 is situated, is an outwardly directed member 48. The unattached edge 50 of member 48 bears against the exterior surface of latch handle 18 when the padlock assembly is mounted on the cargo door and the shield is in the covered position. Member 48 further stabilizes the padlock assembly when it is locked on the cargo door. Member 48 also prevents the insertion of a tool between the shield and the latch handle which could pry the padlock assembly from the door.

Spaced openings 52 are situated in shield wall 32 a short distance from either side of member 48. Openings 52 are present such that the bracket parts 14 can extend into the interior space defined by shield wall 32 and engage shackle section 26 without limiting the range of movement of the shield relative to the padlock when the lock body is in its unlocked position. Accordingly, the shield may be moved to its locked position without interference from the bracket parts. In that position the lock body can be moved to its locked position in which the lock body prevents the shield from being moved to expose the lock body and shackle.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims:

I claim:

1. A padlock assembly comprising padlock having a lock body and a generally "U" shaped shackle, said lock body being moveable relative to said shackle between locked and unlocked positions, said shackle comprising an elongated section having an end attached to said lock body, said assembly further comprising a protective shield moveable between a covered position and an uncovered position, said shield comprising a wall having the shape of a cylindrical section defining an interior space, a tubular member permanently affixed to said shield wall through which said elongated section of said shackle extends, such that in the unlocked position of said lock body said shield may be moved to its uncovered position in which said lock body is exposed, and said shield may be moved to its covered position wherein said shackle and at least a portion of said lock body are situated in said interior space of said shield, wherein said lock body may be moved to its locked position in which said lock body cooperates with said shield to prevent said shield from being moved from its covered position to expose said lock body and shackle, wherein said shield comprises an open end and said assembly further comprises an arcuate collar extending from said shield proximate said open end, said collar defines an interior space adapted to receive a portion of said lock body, when said lock body is in its locked position.

2. The assembly of claim 1 wherein said end of said elongated section of said shackle is attached to said lock body for linear and rotational movement relative to said lock body.

3. The assembly of claim 1 wherein said shield has an edge and wherein a portion of said arcuate collar overlaps and extends beyond said edge of said shield, and wherein said portion of said collar has a diameter which is larger than the diameter of said shield.

4. The assembly of claim 3 wherein said portion of said collar is large enough to receive at least a portion of said lock body, when said lock body is in its locked position.

5. A padlock assembly for use with a door and a fixed bracket having spaced protruding parts with aligned openings and a latch handle moveable between a first position wherein the door may be opened and a second position, between the protruding parts of the bracket, wherein the door cannot be opened, said assembly comprising a padlock including a lock body and a generally "U" shaped shackle, said lock body being moveable relative to said shackle between locked and unlocked positions, said shackle comprising a first elongated section having an end attached to said lock body and a second elongated section, said assembly further comprising a protective shield moveable between a covered position and an uncovered position relative to said padlock, said shield comprising a wall defining an interior space, a tubular member permanently affixed to said shield wall through which said first elongated section of said shackle extends, such that in the unlocked position of said lock body, said shield may be moved to its uncovered position in which said lock body is exposed and in which said second elongated section of said shackle may be received in the aligned openings of the bracket parts when the latch handle is in its second position, and said shield may be moved to its covered position, wherein said shackle and at least a portion of said lock body are situated in said interior space of said shield, and wherein said lock body may be moved to its locked position in which said lock body cooperates with said shield to prevent said shield from being moved from its covered position to expose said lock body and shackle, wherein said shield has an exterior surface and said assembly further comprises a member extending from said exterior surface of said shield toward the latch handle to stabilize said assembly and prevent the insertion of a tool between said shield and the latch handle.

6. The assembly of claim 5 wherein said end of said first elongated section of said shackle is attached to said lock body for linear and rotational movement relative to said lock body.

7. The assembly of claim 5 wherein said member comprises first and second sides and further comprising an opening in said shield wall proximate each of said member sides such that the spaced protruding parts of the door bracket can extend into the interior space of the shield for engagement with said second elongated section of said shackle.

* * * * *